United States Patent [19]

Demler

[11] Patent Number: 5,046,672

[45] Date of Patent: Sep. 10, 1991

[54] REFINER PLATE GROOVE CONFIGURATION

[75] Inventor: Christopher L. Demler, Westfield, Mass.

[73] Assignee: Beloit Corporation, Beloit, Wis.

[21] Appl. No.: 579,426

[22] Filed: Aug. 31, 1990

[51] Int. Cl.[5] ..... B02C 7/12

[52] U.S. Cl. ..... 241/296

[58] Field of Search ..... 162/261, 20, 23; 241/261.3, 296, 298

[56] References Cited

U.S. PATENT DOCUMENTS 108,422 10/1970 Wohlenberg ..... 241/296

4,039,154 8/1977 Peterson ..... 241/296

*Primary Examiner*—Karen M. Hastings

*Attorney, Agent, or Firm*—Dirk J. Veneman; Raymond W. Campbell

[57] ABSTRACT

A refiner plate for a pulp refiner in which a sub-groove is provided in the refiner grooves, the sub-groove extending inwardly in the plate from the bottom of the refiner groove. The refiner plate is useful for shortening long fibers in a pulp slurry without treating short fibers present in the slurry.

13 Claims, 1 Drawing Sheet

REFINER PLATE GROOVE CONFIGURATION

BACKGROUND OF THE INVENTION i. Technical Field

The present invention relates generally to the field of cellulose fiber refiners used in the papermaking industry, and relates more specifically to an improved design for grooves in refiner plates particularly useful for reducing the length of long fibers without overly treating short fibers in the slurry.

ii. Technical Background

A paper sheet is comprised of a network of cellulose fibers randomly distributed and bonded together as water is removed from a slurry of pulp during formation of the sheet. Many of the formation characteristics of the pulp and physical qualities of the resulting sheet are dependent on the strength of the fibers themselves, the number and strength of bonds formed between adjacent fibers, and other physical characteristics of the fibers. Pulp refiners have been used to mechanically treat the fibers, such as to fibrillate or fray the ends and walls of the fibers, thus increasing surface area and increasing bonding sites between fibers. Flexure of the fibers during the refining process increases flexibility by breaking bonds between concentric layers in the individual fibers.

Different wood species exhibit different fiber characteristics and sheet formation qualities. Fiber length and cell wall thickness have a significant effect on the properties of paper formed. The relationship between tear strength, for example, and the length of fibers used in the sheet is virtually directly proportional. Typically, hard woods provide a higher percentage of shorter fibers. Soft woods, on the other hand, are composed of higher percentages of long tapering cells, and certain soft wood species, such as Douglas Fir and Redwood, have relatively thick fibers which tend to produce sheets of high tear resistance but low burst and tensile strength. Papermakers attempt to control various fiber characteristics to achieve strength as well as surface characteristics of the resulting sheet. Whereas long fibers tend to yield stronger pulps, certain surface characteristics, such as smoothness, opacity and the like, are developed by the short fibers.

For these reasons, fibers developed differently, or from differing species, often are mixed. In some regions, such as the West Coast of the United States, hard woods are in short supply while there are abundant supplies of soft woods, such as Douglas Fir and Redwood. Pulps from many of these soft wood species exhibit extreme formation problems, such as flocculation, which is the agglomeration or clumping of fibers, preventing even fiber distribution.

It is sometimes beneficial when using soft woods to treat the long fibers by shortening them without significant treatment to already present short fibers. Conventional long fiber treatment has been attempted using high intensity refining including the use of coarse refining plates run at slow speed using low consistency pulp. High intensity refiners of this type are difficult to operate, and exhibit rapid plate wear resulting in high operation costs. In conventional refining of this type, any significant long fiber treatment has resulted in significant fines generation and an accompanying drop in freeness. While certain levels of changes in freeness and fines percentages can be tolerated, unfortunately, any appreciable effect on the long fibers has been accompanied by excessive fines generation and drops in freeness.

SUMMARY OF THE INVENTION

It is, therefore, one of the primary objects of the present invention to provide a pulp treating apparatus which can advantageously treat long fibers present in a slurry of pulp while minimally treating short fibers present in the slurry.

Another object of the present invention is to provide an apparatus for treating soft wood pulps so that the soft wood pulps exhibit characteristics more like hard wood pulps, including generating in the soft wood pulp a higher percentage of short fibers relative to long fibers, while maintaining a high degree of drainability.

A further object of the present invention is to provide an apparatus for creating an artificial hard wood, by treating soft wood pulps to exhibit hard wood pulp characteristics, which apparatus operates simply and efficiently along known parameters currently used by pulp mill operators.

Yet another object of the present invention is to provide a refiner plate groove design suitable for shortening significant percentages of long fibers in long fiber pulps without significantly increasing the percentage of fines in the pulp.

A still further object of the present invention is to provide a refiner plate design useful for shortening long fibers in a pulp slurry which can be operated in a conventional refiner at lower intensity than previously known refiner operation for long fiber treatment, and which reduces plate wear from that in high intensity refiners.

These and other objects are achieved in the present invention by providing modified refiner plates for a standard pulp refiner. Specifically, a sub-groove is provided in each groove of the refiner plate, the sub-groove being disposed in the bottom of the refiner groove and being narrower in width than the standard refiner groove. Conventional bar widths and spacings can be used for operating at lower intensity than previous refiner operations for fiber shortening.

In operation, an apparent degree of fractionation and fiber orientation occurs, with the shorter fibers being removed from the refining zones at the bar edges of the plates, and with the longer fibers being presented at the bar edges in such a fashion that fiber length is reduced.

DETAILED DESCRIPTION OF THE PREFERRED EMBODIMENT

Figure 1:
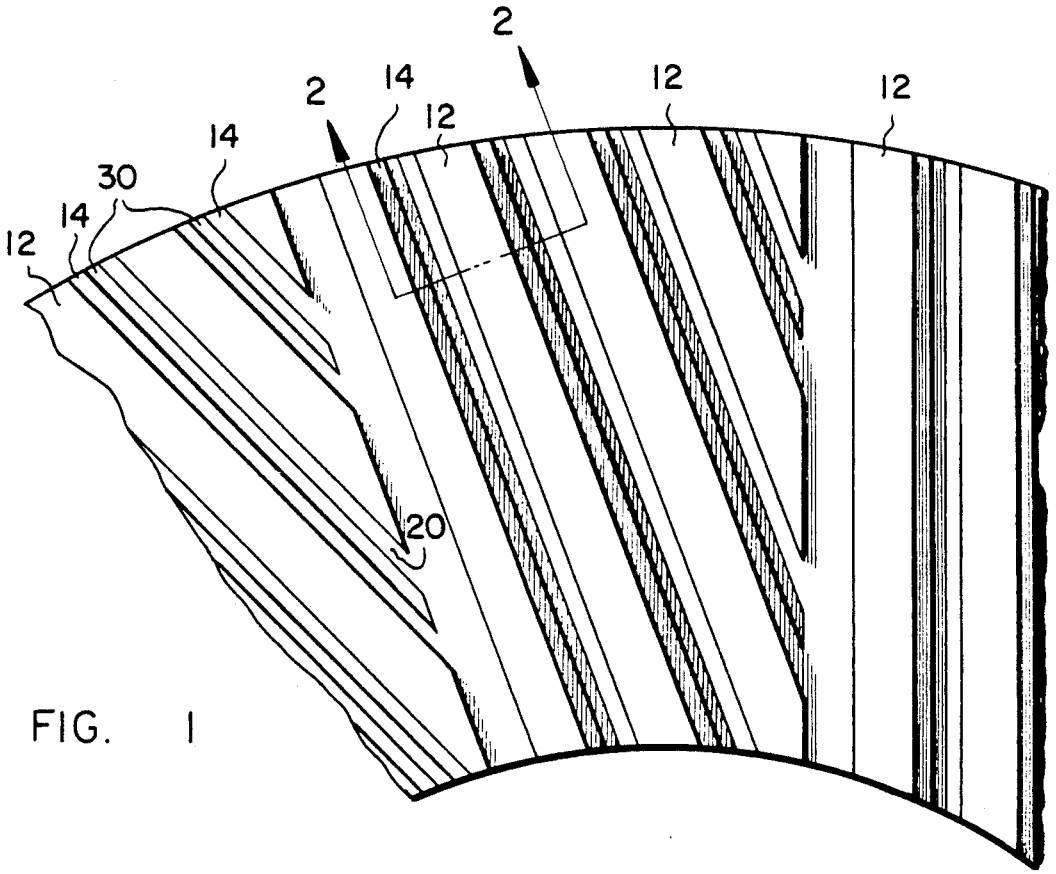
FIG. 1 is a fragmentary plan view of a refiner plate having the groove configuration of the present invention.

Referring now more specifically to the drawings, and to FIG. 1 in particular, numeral 10 designates a refiner plate of the present invention for use in a standard pulp refiner. The plate 10 may be used in various types of refiners suitable for use in the pulp and paper industry, which are well-known to those versed in the art and will not be described in further detail herein. Plate 10 is made of metal, preferably, or other hard, rigid material suitable for conventional pulp refiner plates, and may be constructed in segments as is well-known to those skilled in the art.

As with conventional pulp refiner plates, the refiner plate 10 includes a plurality of bars 12 and grooves 14 arranged in a pattern on the plate surface. Groove 14 is defined by side walls 16 and 18 and a bottom 20. Various groove angles and pattern groupings are known, many of which may be suitable for use in the present invention.

In accordance with the present invention, a sub-groove 30 is provided in the bottom 20 of the groove 14. The sub-groove is defined by side walls 32 and 34 and a sub-groove bottom 36. The sub-groove communicates openly and directly with groove 14, along a sub-groove opening 38, and extend inwardly in the plate from the bottom 20 of the groove 14.

Use of the sub-groove has resulted in long fiber treatment, including fiber length reduction, without significant treatment to short fibers present in the slurry. Further details of testing carried out using a refiner plate constructed in accordance with the principles of the present invention will be described in greater detail hereinafter.

Figure 2:
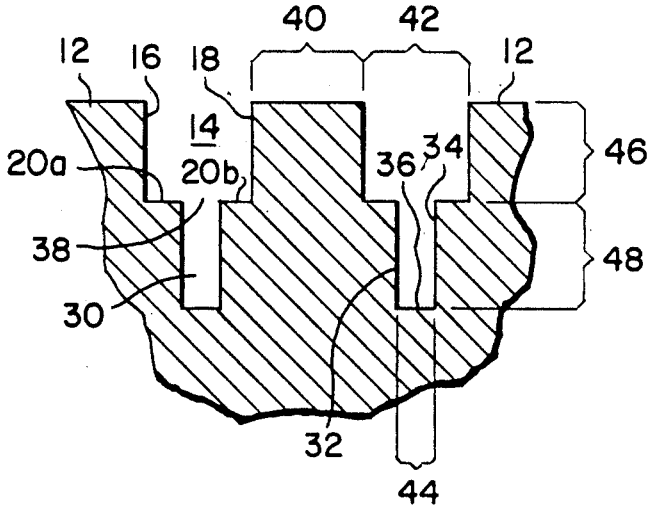
FIG. 2 is a cross-sectional view of the refiner plate shown in FIG. 1, taken along line 2—2 of FIG. 1.

Various dimensions for the refiner plate 10 are indicated in FIG. 2. The bar width dimension has been designated as numeral 40, the groove width dimension designated by numeral 42 and the sub-groove width designated by the numeral 44. Groove depth has been indicated by the numeral 46 and sub-groove depth by the numeral 48. As can be seen in FIG. 2, each sub-groove with its respective groove forms a cross sectional area that decreases stepwise where the subgroove communicates openly with its respective groove bottom.

In a known design suitable for use on Redwood and Fir, groove widths between 3/16 and 5/16 inch have been used with a sub-groove width of 1/16 inch, the sub-groove being centered in the bottom of the groove, and dividing the bottom 20 into equal segments 20*a* and 20*b*. Groove depth of 2/16 inch and sub-groove depth of 2/16 inch were found to operate advantageously. Bar widths between 1/16 and 5/16 inch were found suitable. While these dimensions are given as a known suitable design, it is believed that, depending upon the pulp characteristics and refiner operating characteristics, various other dimensions also may be suitable. Groove depths as great as 5/16 inch and as wide as ½ inch and as narrow as ⅛ inch may be used with a proportional sub-groove to achieve desired refiner treatment of fibers.

Furnishes other than Redwood and Fir require different fiber treatment. Those familiar with the art accomplish this by changing plate patterns. It, therefore, follows that by varying the sub-groove location, the grooved plate can be effectively used with other furnishes with different refining requirements. The location of the sub-grooves may be varied within the main groove width to achieve the desired refining action. Multiple sub-grooves varying in width from 1/32 to 3/16 inch may be used. Additionally, the sub-groove location may be varied between the groove side walls, and may be in alignment with one or the other side wall.

In tests performed, appreciable fiber length reduction has been achieved while maintaining high freeness levels with minimal fines generation. For example, in tests performed using a standard refiner plate and a plate of the same general design but having a sub-groove of the present invention, the following results were obtained at an intensity of 6 Ws/m.

| | Standard Plate | Sub-grooved Plate |
|---|---|---|
| Net Energy Input - 4 HPD/BDT | | |
| Canadian Standard Freeness | 540 | 560 |
| % Long Fiber (14 mesh retention) | 30 | 15 |
| Breaking Length (meters) | 5,200 | 4,850 |
| Tear Factor (nM · $m^2$/g) | 170 | 140 |
| Bulk ($cm^3$/g) | 1.71 | 1.7 |
| Burst (kPa) | 38.3 | 30 |
| Net Energy Input - 6 HPD/BDT | | |
| Canadian Standard Freeness | 410 | 440 |
| % Long Fiber (14 mesh retention) | 22 | 2 |
| Breaking Length (meters) | 5,750 | 4,200 |
| Tear Factor (nM · $m^2$/g) | 140 | 100 |
| Bulk ($cm^3$/g) | 1.64 | 1.65 |
| Burst (kPa) | 42.6 | 24.7 |

It is evident from the above results that the sub-grooved refiner plate significantly reduced long fiber lengths without significantly affecting the short fiber lengths. At 4 HPD/BDT, long fiber percentage was reduced from 30% to 15%, and the reductions in breaking length, tear and burst were consistent with the reduction in long fibers. However, the freeness of the pulp treated by the sub-grooved plate is higher than the freeness of the pulp treated on the standard plates. Therefore, it is clear that the treatment by the sub-grooved plate is highly selective, treating only the long fiber, and not shortening short fibers, thereby generating fines.

The results at 6 HPD/BDT were similar. Long fiber was reduced from 22% to 2%, with corresponding reductions in breaking length, tear and burst. However, again, the Canadian Standard Freeness measurement of the resulting pulp was higher for the sub-grooved plate than for the standard plate, just the opposite from that result normally achieved with high intensity refining to reduce fiber length.

While the manner in which the present plates selectively treat long fiber without treating short fiber or generating significant fines is not completely known, two theories have been proposed for the operation of the sub-groove with the standard groove. First, it is believed that fines, short fibers and liquid tend to flow into the sub-groove, thereby being removed from the refining zone at the bar edges. It is also believed that orientation of the long fibers occurs, in effect, standing the long fibers up in the groove, thereby presenting them at the bar edges for length reduction. Since the short fibers are removed from the refining zone, fines are not generated from short fiber length reduction. It may, in fact, be that a combination of both phenomenons occur, or the results could be from phenomena other than those proposed. These theories are offered only as possible working solutions as to the plate operation.

The improved refiner plates of the present invention can be manufactured using known refiner plate manufacturing techniques. The plates can be manufactured in sizes corresponding to existing conventional refiner sizes and can be used in conventional refiners, such as conventional double disk refiners. Normally, the improved refiner plates are provided on both the stator and rotor plate surfaces, with the sub-grooves being in each refiner plate groove. However, it may be useful in some applications to provide sub-grooves in less than all refiner grooves.

A refiner plate groove configuration has been shown and described herein, which is effective for selective long fiber shortening. However, various changes may be made without departing from the scope of the present invention.

What is claimed is:

1. In a pulp refiner plate for mechanically treating pulp fibers to alter physical characteristics of the fibers, said refiner plate having a plurality of refiner bars separated by refiner grooves, the bars and grooves being arranged in patterns suitable for treating a slurry of pulp passed between opposed relatively rotating surfaces of two of said refiner plates, each groove having a groove bottom, the improvement comprising sub-grooves disposed in the groove bottom of at least some of the refiner grooves, each said sub-groove being narrower in width than its respective groove and communicating openly with its respective groove bottom, each said sub-groove with its respective groove forming a cross sectional area that decreases stepwise where the sub-groove communicates openly with its respective groove bottom.

2. The, improved refiner plate as recited in claim 1, wherein each said sub-groove is centered at its respective groove bottom, and openly communicates with its respective groove along a sub-groove opening equally spaced from side walls defining said respective groove.

3. The improved refiner plate as defined in claim 1, wherein the depth of each said sub-groove is approximately equal to the depth of its respective groove.

4. The improved refiner plate as defined in claim 1, wherein the width of each said sub-groove is approximately one-half the width of its respective groove.

5. The improved refiner plate as recited in claim 4, wherein each said sub-groove is centered at its respective groove bottom, and openly communicates with its respective groove along a sub-groove opening equally spaced from side walls defining said respective groove.

6. The improved refiner plate as defined in claim 4, wherein the depth of each said sub-groove is approximately equal to the depth of its respective groove.

7. The improved refiner plate as recited in claim 6, wherein each said sub-groove is centered at its respective groove bottom, and openly communicates with its respective groove along a sub-groove opening equally spaced from side walls defining said respective groove.

8. A refiner plate for mechanically treating pulp fibers to alter physical characteristics of the fibers, said refiner plate comprising a body of hard, rigid material having a plurality of grooves extending inwardly from a surface thereof, each of said grooves having opposed groove side walls spaced from each other and a groove bottom, said grooves extending in said surface generally from inner portions of the body to generally outer portions of the body, and sub-grooves disposed in at least some of said groove bottoms, each said sub-groove being generally parallel to its respective groove and each sub-groove being defined by opposed sub-groove walls spaced from each other less than the spacing between its respective groove side walls, and a sub-groove bottom between each said sub-groove side walls, each said sub-groove communicating openly with its respective groove at said groove bottom.

9. A refiner plate as defined in claim 8 in which each said sub-groove side walls are parallel.

10. The refiner plate defined in claim 8 in which each said sub-groove side walls are spaced from each other approximately one-half the distance between its respective groove side walls.

11. The refiner plate as defined in claim 8 in which the height of said groove side walls from said groove bottoms to said surface of said refiner plate is substantially the same as the height of said sub-groove side walls from said sub-groove bottom to said groove bottoms.

12. The refiner plate as defined in claim 8 in which said groove side walls and said sub-groove side walls of any one groove and its associated sub-groove are disposed in parallel planes.

13. The refiner plate as defined in claim 8 in which each said sub-groove divides its respective groove bottom into first and second segments of equal widths.

* * * * *

UNITED STATES PATENT AND TRADEMARK OFFICE

CERTIFICATE OF CORRECTION

PATENT NO. : 5,046,672

DATED : 09/10/91

INVENTOR(S) : Christopher Demler, Luigi Silveri

It is certified that error appears in the above—identified patent and that said Letters Patent is hereby corrected as shown below:

TITLE PAGE
Line [75]
"Inventor": Luigi Silveri is added as a listed inventor.

Signed and Sealed this

Twelfth Day of January, 1993

*Attest:*

*Attesting Officer*

DOUGLAS B. COMER

*Acting Commissioner of Patents and Trademarks*